US009365043B2

(12) United States Patent
Toda et al.

(10) Patent No.: US 9,365,043 B2
(45) Date of Patent: Jun. 14, 2016

(54) LIQUID EJECTION HEAD

(71) Applicant: CANON KABUSHIKI KAISHA, Tokyo (JP)

(72) Inventors: Kyosuke Toda, Kawasaki (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/718,653

(22) Filed: May 21, 2015

(65) Prior Publication Data

US 2015/0343787 A1 Dec. 3, 2015

(30) Foreign Application Priority Data

May 30, 2014 (JP) ..... 2014-112188
Apr. 23, 2015 (JP) ..... 2015-088613

(51) Int. Cl.

| | |
|---|---|
| ***B41J 2/14*** | (2006.01) |
| ***B41J 23/00*** | (2006.01) |
| ***B41J 2/175*** | (2006.01) |
| ***B41J 2/045*** | (2006.01) |

(52) U.S. Cl.

CPC ..... *B41J 2/1753* (2013.01); *B41J 2/04548* (2013.01)

(58) Field of Classification Search

CPC .. B41J 2/04548; B41J 2/1753; B41J 2/17546; B41J 2/17553; B41J 2/17559; B41J 25/304; B41J 2/17526

USPC ..... 347/37, 49, 50, 85, 86

See application file for complete search history.

(56) References Cited

U.S. PATENT DOCUMENTS 6,502,917 B1 * 1/2003 Shinada ..... D06M 13/44 347/19
7,125,109 B2 * 10/2006 Watanabe ..... B41J 2/1752 347/19

FOREIGN PATENT DOCUMENTS

JP 2005-212221 A 8/2005

* cited by examiner

*Primary Examiner* — An Do
(74) *Attorney, Agent, or Firm* — Fitzpatrick, Cella, Harper & Scinto

(57) ABSTRACT

Provided is a liquid ejection head, including: a connector unit; and a case in which the connector unit is movably placed. The connector unit includes: an electric contact member; and a housing configured to fix a portion between one end and another end of the electric contact member. The electric contact member includes a conductive member, the conductive member including an elastically deformable first electric contact portion formed on the one end side thereof, and an elastically deformable second electric contact portion formed on the another end side thereof.

20 Claims, 6 Drawing Sheets

LIQUID EJECTION HEAD

BACKGROUND OF THE INVENTION

1. Field of the Invention

The present invention relates to a liquid ejection head.

2. Description of the Related Art

Some of widely-used inkjet printers include a liquid ejection head for ejecting liquid (ink) and a liquid cartridge for containing the liquid, the liquid cartridge being replaceable. In Japanese Patent Application Laid-Open No. 2005-212221, there is disclosed a printer in which a liquid cartridge includes a storing unit, the storing unit storing data such as a type and a remaining amount of the liquid, the data stored in the storing unit being acquired when the liquid cartridge is replaced. Further, some of such printers include a connector unit (contact conduction member) having an electric contact portion for electric connection for acquiring the data.

When the liquid cartridge is replaced, it is necessary to electrically connect the storing unit (electric substrate) of a newly mounted liquid cartridge to the connector unit. Therefore, the electric contact portion of the connector unit is elastically displaceable in a direction perpendicular to a contact surface of the electric substrate so as to be brought into contact with the liquid cartridge without fail even if a fixed position of the liquid cartridge varies to some extent. As a stroke of the elastic displacement of the electric contact portion becomes longer, a range in which the electric connection can be secured becomes wider, but at the same time, there is a higher risk of plastic deformation and breakage of the electric contact portion.

SUMMARY OF THE INVENTION

According to one embodiment of the present invention, there is provided a liquid ejection head, including:

a connector unit including:

a first electric contact portion and a second electric contact portion for electric connection; and a fixing portion configured to fix the first electric contact portion and the second electric contact portion; and a first electric substrate electrically to be connected to the first electric contact portion, in which each of the first electric contact portion and the second electric contact portion has spring force, and in which the spring force of the first electric contact portion and the spring force of the second electric contact portion are in opposite directions.

According to one embodiment of the present invention, there is provided a liquid ejection head, including:

a connector unit including:

an electric contact member including a conductive member which includes an elastically deformable first electric contact portion formed on one end side thereof, and an elastically deformable second electric contact portion formed on another end side thereof; and a housing configured to fix a portion between the one end and the another end of the electric contact member; and a case in which the connector unit is movably placed.

Further features of the present invention will become apparent from the following description of exemplary embodiments with reference to the attached drawings.

DESCRIPTION OF THE EMBODIMENT

An embodiment of the present invention is described in the following with reference to the attached drawings.

(First Embodiment)

Figure 1:
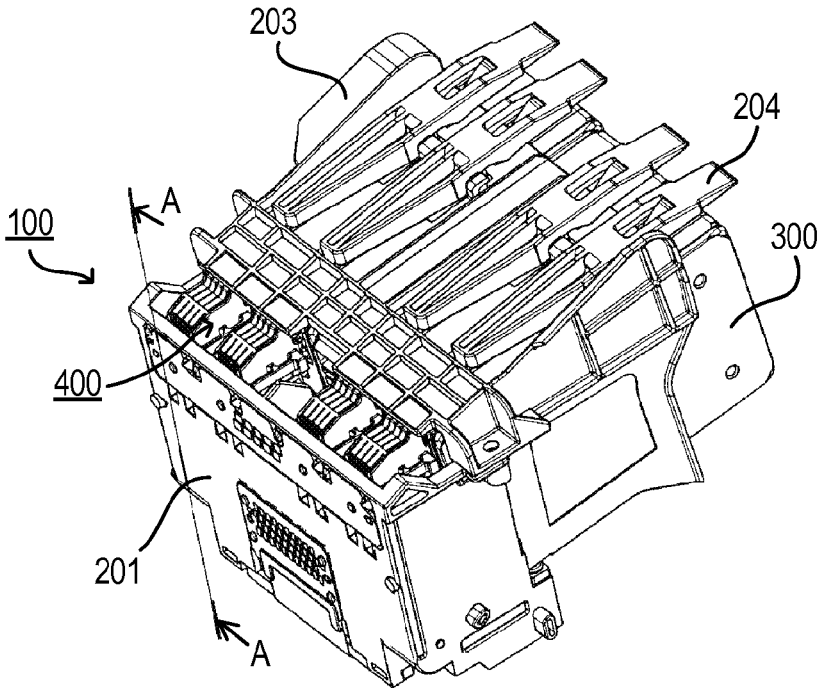
FIG. 1 is a perspective view of a liquid ejection head according to an embodiment of the present invention.
Figure 2:
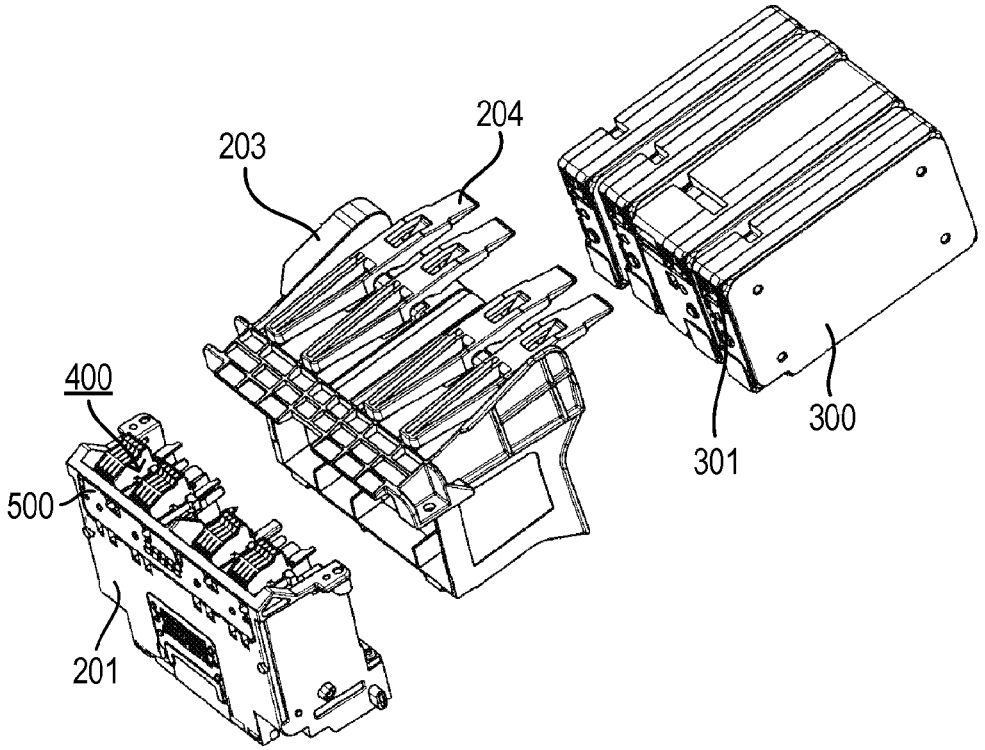
FIG. 2 is an exploded perspective view of the liquid ejection head illustrated in FIG. 1.

FIG. 1 is a perspective view of a liquid ejection head 100 according to an embodiment of the present invention, and FIG. 2 is an exploded perspective view thereof. A liquid cartridge 300 that contains liquid (ink) is mounted to the liquid ejection head 100. The liquid ejection head 100 includes a case 201 and a cover 203 that covers the mounted liquid cartridge 300. A lever 204 configured to fix the liquid cartridge 300 is arranged in the cover 203.

Figure 3:
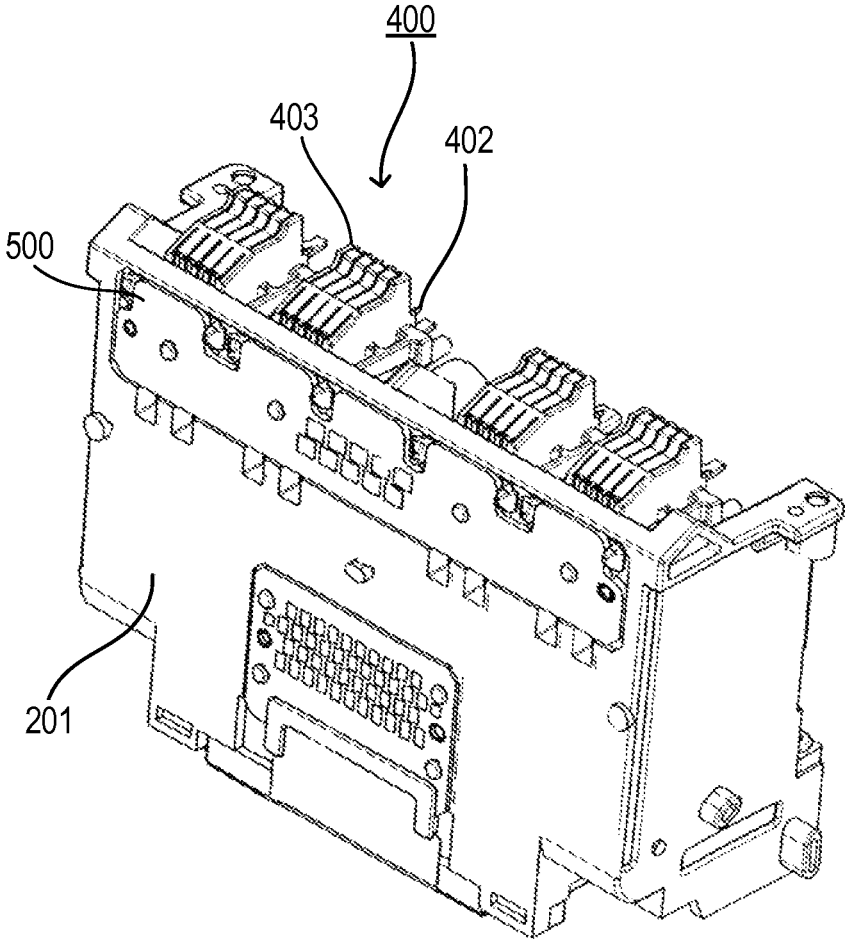
FIG. 3 is a perspective view illustrating a case and a connector unit of the liquid ejection head illustrated in FIG. 1.
Figure 4:
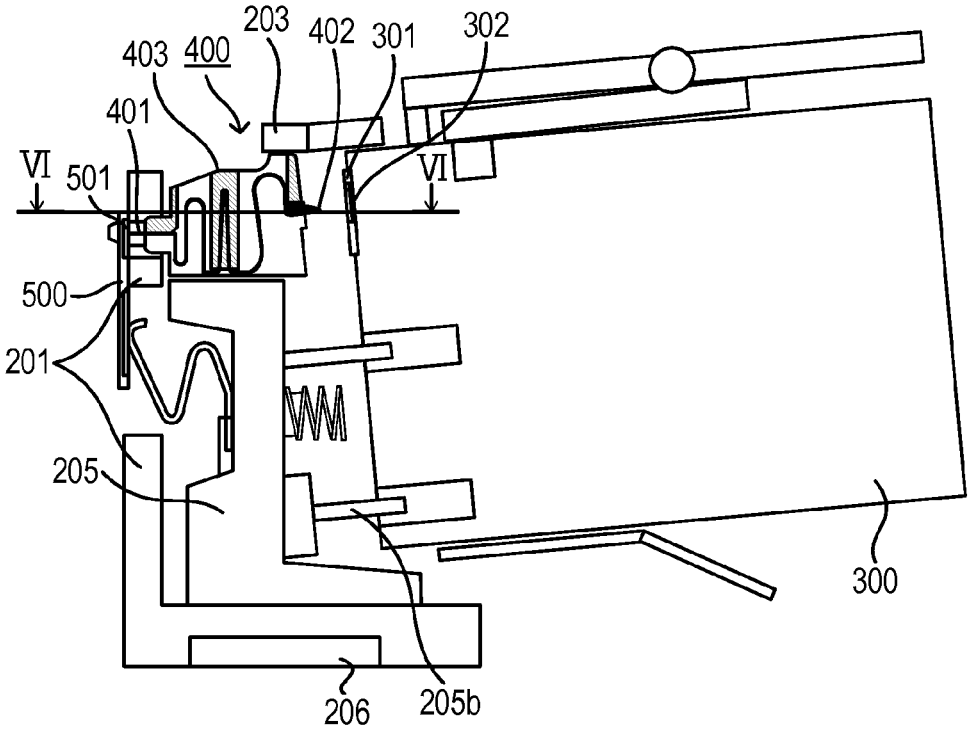
FIG. 4 is a sectional view taken along the line A-A of FIG. 1 illustrating a liquid cartridge of the liquid ejection head before fixing thereof is completed.
Figure 5:
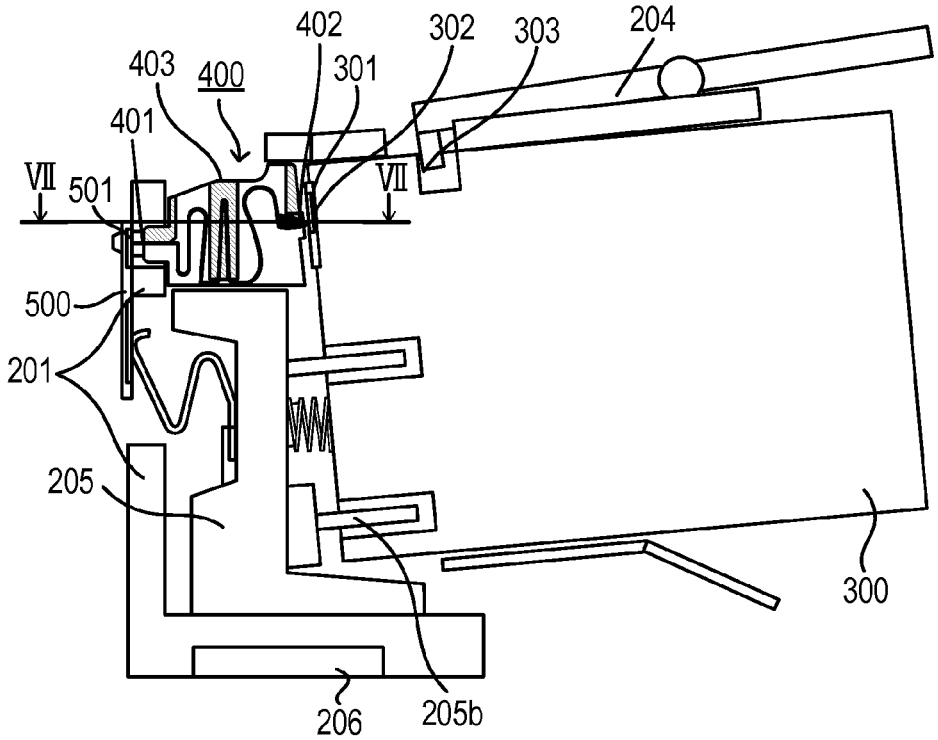
FIG. 5 is a sectional view taken along the line A-A of FIG. 1 illustrating the liquid cartridge of the liquid ejection head after fixing thereof is completed.

As illustrated in FIGS. 3 to 5, a connector unit 400 for electric connection and a connector substrate (first electric substrate) 500 that includes a contact pad 501 are mounted to the case 201. The connector unit 400 includes a housing 403 formed of a resin member and an electric contact member that is a conductive member. The electric contact member includes elastically deformable first contact pins 401 arranged at one end and elastically deformable second contact pins 402 arranged at another end. The connector unit 400 has a structure in which the first contact pins 401 located on the connector substrate 500 side and the second contact pins 402 located on the liquid cartridge 300 side are mounted to the housing 403 that is formed by resin molding. The first contact pins 401 and the second contact pins 402 are integral with each other, and are formed of a conductive member such as a plate-like spring part. A portion between the first contact pins 401 and the second contact pins 402 is fixed to the connector unit to inhibit an adverse effect of spring displacement (spring force) of contact pins at one end on contact pins at another end. In this embodiment, the fixing is attained by press-fitting the plate-like portion between the first contact pins 401 and the second contact pins 402 into a gap formed in the connector unit. The first contact pins 401 are a first electric contact portion and the second contact pins 402 are a second electric contact portion. A liquid supply member 205 is mounted to the case 201, and the liquid cartridge 300 is mounted to the case 201 via the liquid supply member 205. An element substrate 206 including ejection orifices configured to eject liquid supplied from the liquid cartridge 300 and energy generating elements configured to generate ejection energy is mounted to the case 201.

After the cover 203 is placed so as to cover the liquid cartridge 300 from above as illustrated in FIG. 4, a tip of the lever 204 is engaged with a recess 303 in an upper surface of the liquid cartridge 300 as illustrated in FIG. 5, thereby fixing the liquid cartridge 300. At this time, a liquid supply tube 205*b* communicating to a flow path in the liquid supply member 205 is inserted into the liquid cartridge 300. The flow path (not shown) formed in the liquid supply member 205 and communicating to the liquid supply tube 205*b* communicates to the ejection orifices in the element substrate 206. Specifically, communication is established from the liquid cartridge 300 via the liquid supply tube 205*b* and the flow path to the ejection orifices in the element substrate 206, and liquid in the liquid cartridge 300 is supplied to the ejection orifices.

Further, the connector unit 400 is arranged above the liquid supply member 205 so as to be located between the case 201 and the liquid cartridge 300. Under a state in which the liquid cartridge 300 is fixed by the lever 204, the first contact pins 401 of the connector unit 400 are electrically connected via a first contact abutting against the contact pad 501 of the connector substrate 500 mounted to the case 201. At the same time, the second contact pins 402 are electrically connected via a second contact abutting against a contact pad 302 of a cartridge substrate (second electric substrate) 301 of the liquid cartridge 300. The cartridge substrate 301 of the liquid cartridge 300 is an electric substrate that includes a storing unit configured to store data such as a color, a type, and a volume of contained liquid (ink). The first contact pins 401 and the second contact pins 402 are electrically connected, and thus, the liquid data stored in the cartridge substrate 301 is transmitted to the connector substrate 500 via the connector unit 400. The connector substrate 500 is connected to a control circuit of a recording apparatus main body via a flexible cable or the like (not shown).

Therefore, in this recording apparatus, liquid (ink) contained in the liquid cartridge 300 is supplied to the element substrate 206 via the liquid supply member 205. A drive signal from the control circuit of the recording apparatus main body is supplied to the energy generating element in the element substrate 206. Ejection energy (for example, thermal energy) generated by the energy generating element ejects a liquid droplet through a corresponding ejection orifice. At this time, the drive signal supplied from the control circuit to the energy generating element is adjusted based on the liquid data stored in the cartridge substrate 301.

Figure 6:
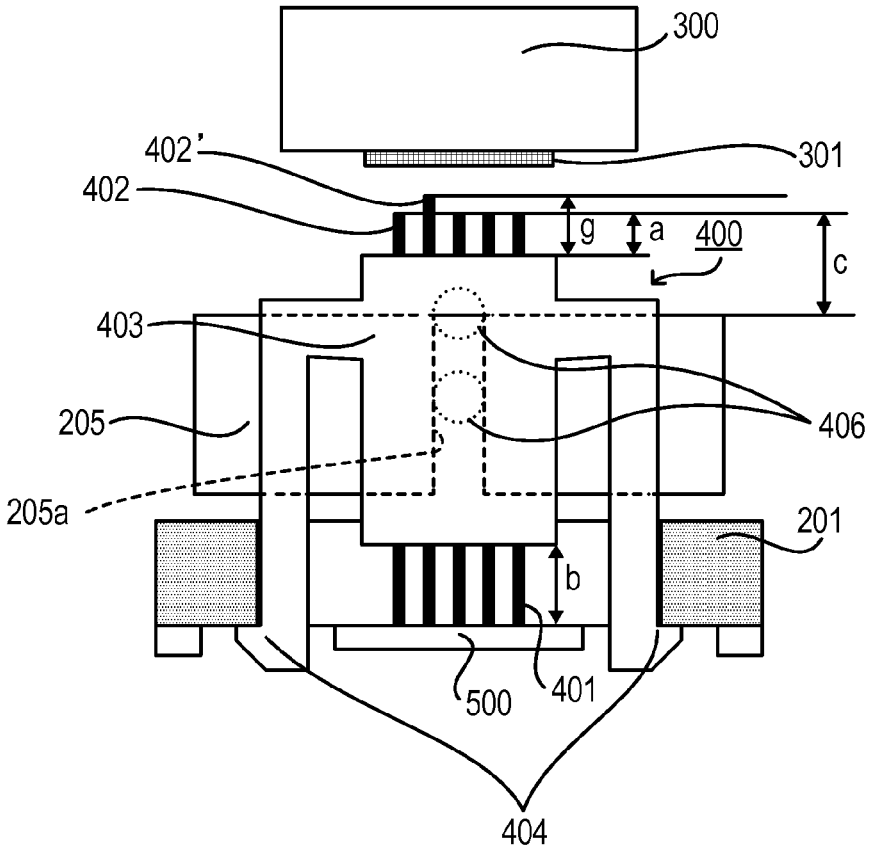
FIG. 6 is a sectional view taken along the line VI-VI of FIG. 4.

Next, a structure of the connector unit 400 is described in further detail. As illustrated in FIG. 6, the connector unit 400 includes claw-like engaging portions 404 of a snap-fit structure, and is adapted to be temporarily fixed to the case 201. The first contact pins 401 and the second contact pins 402 are integral parts formed by blanking a plate-like spring member by press working, and are press-fit into the housing 403 to be fixed.

Figure 7:
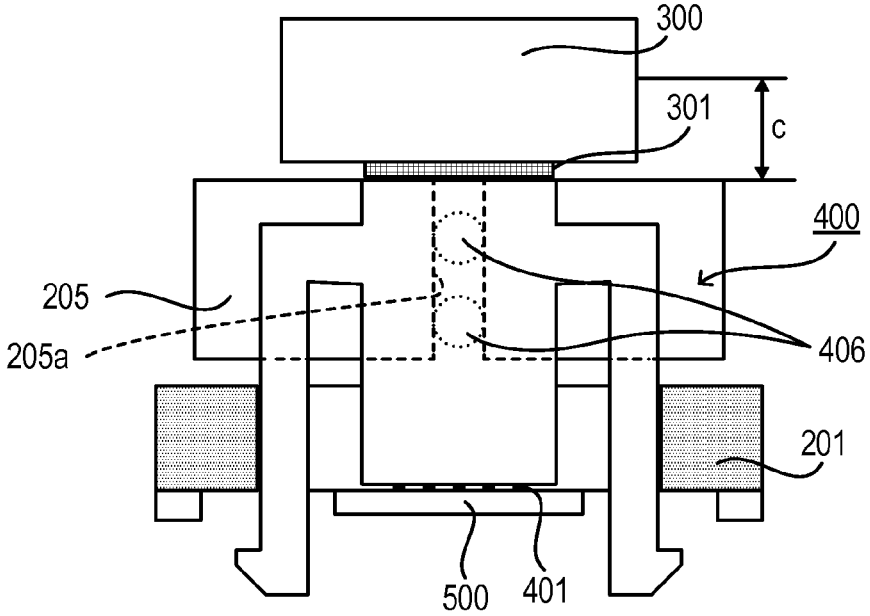
FIG. 7 is a sectional view taken along the line VII-VII of FIG. 5.

FIG. 6 illustrates a state in which the connector unit 400 is engaged with the case 201. FIG. 7 illustrates engaged portions of the connector unit 400 and the case 201 when the liquid cartridge 300 is fixed to the liquid supply member 205 by the lever 204. In this embodiment, snap fit of the engaging portions 404 brings the housing 403 of the connector unit 400 in proximity to the connector substrate 500 mounted to the case 201. Further, when the liquid cartridge 300 is fixed by the lever 204, the cartridge substrate 301 of the liquid cartridge 300 presses the housing 403 via the second contact pins 402. As a result, engagement of the housing 403 by the engaging portions 404 and pressing by the liquid cartridge 300 fixed to the lever 204 of the housing 403 reduces an interval between the housing 403 and the connector substrate 500. This elastically deforms the first contact pins 401 located in the interval to be strongly pressed against the contact pad 501 while reducing a protruding amount thereof from the housing 403. At this time, the second contact pins 402 are elastically deformed to be strongly pressed against the contact pad 302 of the cartridge substrate 301 while reducing a protruding amount thereof from the housing 403.

In this way, the first contact pins 401 are pressed against the contact pad 501 of the connector substrate 500, and the second contact pins 402 are pressed against the contact pad 302 of the cartridge substrate 301. One reason for this is that a direction of spring force of the first contact pins 401 and a direction of spring force of the second contact pins 402 are opposite to each other. If the directions of the spring force of the first contact pins 401 and the spring force of the second contact pins 402 are not opposite to each other, for example, force pressing the first contact pins 401 against the connector substrate 500 does not act much so as to press the second contact pins 402 against the cartridge substrate 301 at the same time, and, in some cases, may act so as to slide the second contact pins 402 from a surface of the cartridge substrate 301. If the directions of the spring force of the first contact pins 401 and the spring force of the second contact pins 402 are opposite to each other, the first contact pins 401 are pressed against the connector substrate 500 substantially perpendicularly, and the second contact pins 402 are pressed against the cartridge substrate 301 substantially perpendicularly. At this time, force that slides the contact pins 401 and 402 from surfaces of the substrates 500 and 301, respectively, almost does not act.

Note that, it is most preferred that the direction of the spring force of the first contact pins 401 and the direction of the spring force of the second contact pins 402 form an angle of 180 degrees, but the angle is not strictly limited to 180 degrees insofar as the directions are substantially opposite to each other. Insofar as the direction of the spring force of the first contact pins 401 and the direction of the spring force of the second contact pins 402 form an angle that is larger than 90 degrees and smaller than 270 degrees, the spring force of one of the contact pins includes a component in a direction opposite to the direction of the spring force of another of the contact pins, and thus, an effect is produced to some extent. When the direction of the spring force of the first contact pins 401 and the direction of the spring force of the second contact pins 402 form an angle that is 135 degrees or larger and 225 degrees or smaller, force to press the contact pins 401 and 402 against the substrates 500 and 301, respectively, is stronger than force to slide the contact pins 401 and 402 from the surfaces of the substrates 500 and 301, respectively. This is effective in enhancing reliability of the connection.

An axis of the first contact pins 401 and an axis of the second contact pins 402 are not the same, and are vertically shifted from each other. This can displace the direction of the spring force of one of the contact pins from the direction of the spring force of the other of the contact pins to inhibit influence on each other. Further, disengagement and misregistration of a portion at which the contact pins and the connector unit are fixed can also be inhibited. Therefore, even if the connector substrate 500 and the cartridge substrate 301 are not in a line, connection thereof can be made. Further, the contact pins 401 and 402 are formed by blanking a spring member, and thus, a large number of contact pins can be formed from one large-sized spring material to reduce manufacturing costs.

The inside of the recording apparatus may be at a high humidity, and thus, it is necessary that the contact pins 401 and 402 have sufficient resistance to corrosion and sufficient conductivity. As an example, the contact pins 401 and 402 are formed of a phosphor bronze material protected by nickel plating on a surface thereof with additional protection by gold plating at tips thereof to be in contact with the substrates 500 and 301, respectively. However, methods of processing and treating surfaces of the contact pins 401 and 402 are not limited thereto insofar as the contact pins 401 and 402 have spring force, are electrically connectable, and are resistant to corrosion in a usage environment.

According the structure of to this embodiment, the connector unit 400 in which the contact pins 401 and 402 are arranged at small pitches can be manufactured at a low cost. However, if a load is applied in a direction orthogonal to the protruding directions of the contact pins 401 and 402 from the housing, there is a high risk that the contact pins 401 and 402 are plastically deformed without recovering their original shape, which is a problem. Therefore, the housing 403 protects the second contact pins 402 while guiding the direction of extension thereof. The protruding amount of the second contact pins 402 from the housing 403 is limited in accordance with a thickness of the material of the contact pin (material to be subjected to press working).

In this embodiment, a direction in which the liquid cartridge 300 is mounted and the surface of the cartridge substrate 301 are substantially perpendicular to each other. Therefore, it is desired that, as illustrated in FIG. 5, even if the position of the liquid cartridge 300 that is fixed by the lever 204 and the recess 303 varies to some extent or an over stroke that is necessary from a structural viewpoint is caused, the resilient contact be secured without fail to establish the electric connection.

FIG. 6 is a sectional view taken along the line VI-VI of FIG. 4, and illustrates a state before the liquid cartridge 300 is fixed by the lever 204. With reference to FIG. 6, the first contact pins 401 and the second contact pins 402 have maximum strokes (maximum protruding amounts) a and b, respectively, with which plastic deformation and breakage do not occur. In this embodiment, the connector unit 400 is not immovably fixed to the connector substrate 500 and the case 201 but is movably held. Specifically, the connector unit 400 is only undetachably engaged by the snap fit of the engaging portions 404, and there is play. Therefore, in this embodiment, the connector unit 400 can be displaced by an amount up to a+b=c. Specifically, compared with a case in which the connector unit 400 is immovably fixed to the connector substrate 500 and the case 201, the maximum stroke of the connector unit 400 can be increased from a to c without plastic deformation and breakage of the first contact pins 401 and the second contact pins 402. Therefore, this embodiment increases a range in which the first contact pins 401 and the second contact pins 402 can be, without fail, in contact with the substrates 500 and 301, respectively, from a distance a to a distance c.

Note that, one of the second contact pins 402 illustrated in FIG. 6 is a GND contact pin (denoted as 402' for the sake of convenience), which is grounded. Depending on specifications of the cartridge substrate 301, it is sometimes necessary to establish electric connection of a GND signal before others in order to acquire information with stability, and thus, in the example illustrated in FIG. 6, a protruding amount of the GND contact pins 402' from the housing is larger (distance g). In order to lower the manufacturing costs, in a step of blanking the material by press working, the GND contact pins 402' and other second contact pins 402 may be formed in the same shape. In such a case, depending on a structure of the housing 403 and a location at which the contact pins are press-fit, the protruding amounts of the respective contact pins from the housing 403 are changed.

The connector unit 400 according to this embodiment includes guide ribs 406 for the purpose of stabilizing strokes of the first contact pins 401 and the second contact pins 402 and inhibiting unintentional deformation thereof. Further, a groove 205*a* is formed in the liquid supply member 205 fixed to the case 201. Engagement of the guide ribs 406 with the groove 205*a* positions the connector unit 400 and guides directions of the strokes of the contact pins 401 and 402. Even if a load is applied in a direction different from the direction of extension of the second contact pins 402 due to insertion of the liquid cartridge 300 or deformation of the liquid ejection head 100, the engagement of the guide ribs 406 with the groove 205*a* can inhibit change in attitude (rotation) of the connector unit 400. Specifically, the guide ribs 406 correct a change in attitude in a rotational direction to inhibit unintentional deformation of the contact pins 402. Further, fixing of the cover 203 to the liquid supply member 205 by a screw or the like also corrects a change in attitude in the rotational direction of the connector unit 400.

In order to maintain the electric connection in the range of the distance c with stability as described above, it is desired that a position at which the tips of the second contact pins 402 start to be in contact with the cartridge substrate 301 be fixed. Further, when a load necessary to mount the liquid cartridge 300 is heavy, operability (usability) is impaired. In this embodiment, the spring force of the first contact pins 401 and the spring force of the second contact pins 402 of the connector unit 400 influence the load necessary for the mounting. From the viewpoint of usability, it is desired that the load necessary until fixing of the liquid cartridge 300 is completed be light. The load on the connector unit 400 is affected by a composite spring constant K3, which is a composite of a spring constant K1 of the first contact pins 401 and a spring constant K2 of the second contact pins 402. The fixing of the liquid cartridge 300 is completed when the lever 204 is engaged with the recess 303. Specifically, the range in which the electric connection is maintained with stability (range of distance c) described above is from the start of the contact of the first contact pins 401 and the second contact pins 402 with the electric substrates 500 and 301, respectively, until the lever 204 is engaged with the recess 303 to complete fixing of the liquid cartridge 300. In this embodiment, the spring constants satisfy K1>K2, and thus, under a state in which the engaging portions 404 are engaged with the case 201, the connector unit 400 is urged by the spring force of the first contact pins 401 having a high spring constant (K1) to be held stably without misregistration. Further, when the liquid cartridge 300 is mounted, resistance in engaging the lever 204 with the recess 303 is the composite spring constant K3 that is lower than K1, and thus, the fixing of the liquid cartridge 300 can be completed relatively with ease.

Figure 8:
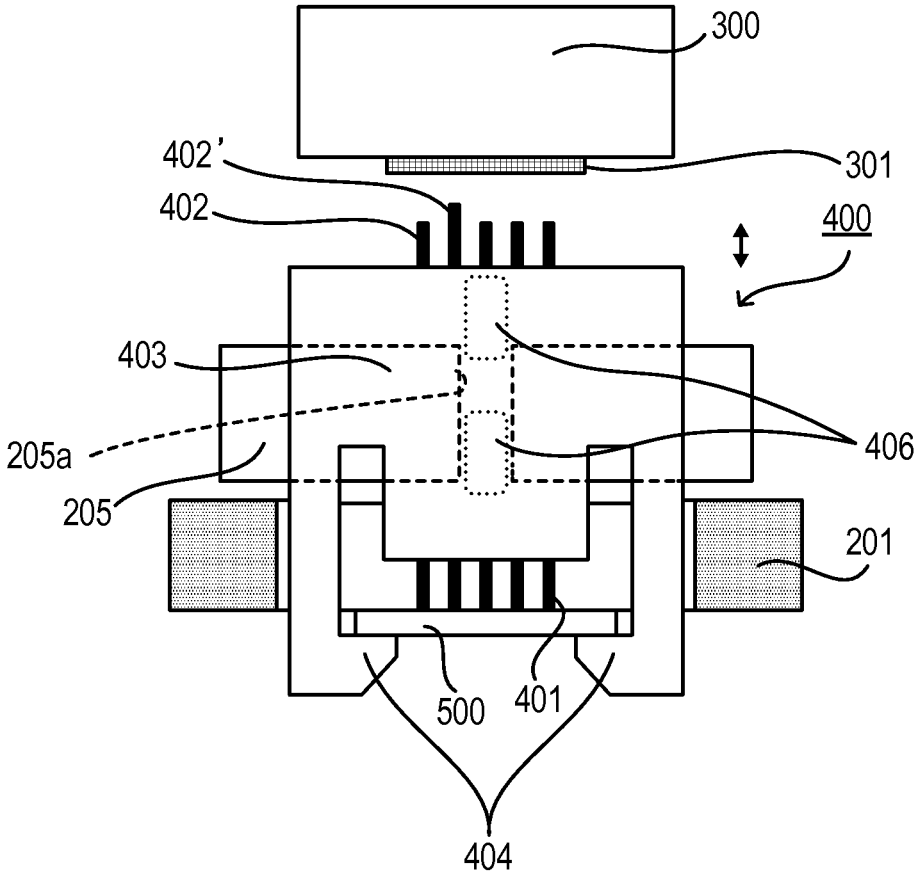
FIG. 8 is a sectional view illustrating a modified example of the liquid ejection head according to the present invention illustrated in FIG. 6.

FIG. 8 illustrates a modified example of this embodiment, and is a sectional view taken along a line corresponding to the line VI-VI of FIG. 4 before the liquid cartridge 300 is mounted. In this modified example, the connector unit 400 is positioned by engagement of the engaging portions 404 not with the case 201 but with the connector substrate 500. The engaging portions 404 may be engaged with the case 201 as illustrated in FIGS. 6 and 7, or, may be engaged with the connector substrate 500 as in this modified example. Further, the engaging portions 404 are not limited to claw-like ones that are oriented outward in a horizontal direction as illustrated in FIGS. 6 and 7, and may be claw-like ones that are oriented inward in the horizontal direction as illustrated in FIG. 8, or may be claw-like ones that are oriented outward or inward in a vertical direction (not shown). A surface of the case 201 to which the element substrate 206 is mounted (support surface) and a surface of the case 201 or the connector substrate 500 that is engaged with the engaging portions 404 (engagement surface) are located so as to be perpendicular to each other. This enables securing with ease a liquid supply path toward the element substrate, independently of the electric connection using the connector unit 400.

Figure 9:
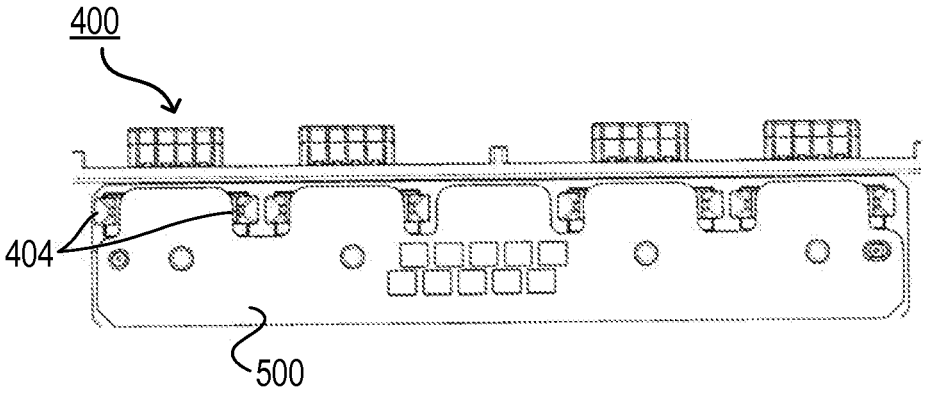
FIG. 9 is a front view illustrating a state of assembly of a connector substrate of the liquid ejection head illustrated in FIG. 1.
Figure 10:
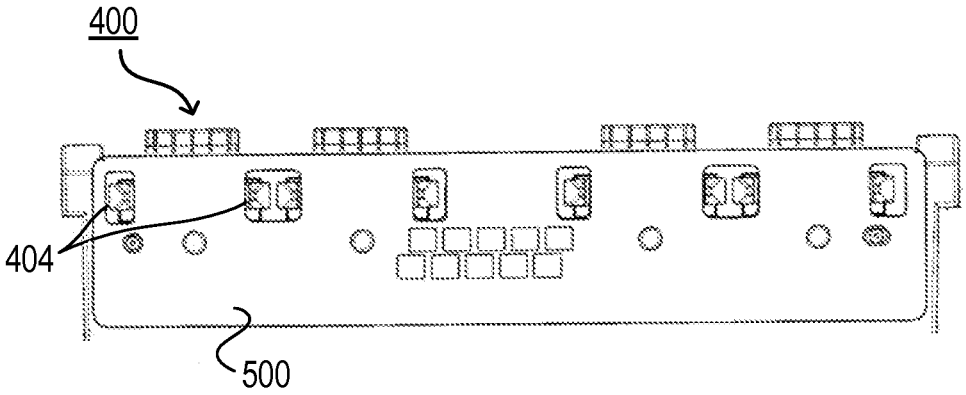
FIG. 10 is a front view illustrating another state of assembly of the connector substrate of the liquid ejection head illustrated in FIG. 1.

In this embodiment, the connector unit 400 is fixed using a snap-fit structure, and thus, assembly is easy and no additional member for the fixing is necessary. In the snap-fit structure, the engagement may be released due to external force when the liquid ejection head is manually handled, due to shakes when dropped, or the like. However, by arranging a part of the connector substrate 500 in an elastic deformation range of the engaging portions 404 as illustrated in FIG. 6, deformation of the engaging portions 404 is limited by the connector substrate 500, and thus, the engaging portions 404 are less liable to be disengaged to inhibit falling of the connector unit 400. Specifically, by fixing the connector substrate 500 as illustrated in FIG. 9 and FIG. 10 after the connector unit 400 is assembled, further deformation of the engaging portions 404 is inhibited and the connector unit 400 is prevented from falling.

In the modified example illustrated in FIG. 8, by arranging, after the connector unit 400 is assembled to the connector substrate 500, the case 201 so that a part thereof interferes with an elastic deformation path of the engaging portions 404, further deformation of the engaging portions 404 is inhibited and the connector unit 400 is prevented from falling.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2014-112188, filed May 30, 2014 and 2015-088613, filed Apr. 23, 2015 which are hereby incorporated by reference herein in their entirety.

What is claimed is:

1. A liquid ejection head, comprising:

a connector unit comprising:

a first electric contact portion and a second electric contact portion for electric connection; and a fixing portion configured to fix the first electric contact portion and the second electric contact portion; and a first electric substrate to be electrically connected to the first electric contact portion, wherein each of the first electric contact portion and the second electric contact portion has spring force, and wherein the spring force of the first electric contact portion and the spring force of the second electric contact portion are in opposite directions.

2. A liquid ejection head according to claim 1, wherein the first electric substrate is mounted to a case, wherein the connector unit includes an engaging portion configured to engage with one of the case and the first electric substrate, and wherein the connector unit is held with respect to the first electric substrate by engagement of the engaging portion with the one of the case and the first electric substrate.

3. A liquid ejection head according to claim 2, wherein the case has an element substrate configured to eject liquid mounted thereto, the element substrate being mounted to a support surface, the one of the case and the first electric substrate having an engagement surface that is engaged with the engaging portion, the support surface and the engagement surface being located so as to be perpendicular to each other.

4. A liquid ejection head according to claim 2, wherein the engaging portion has a shape of a claw having a snap-fit structure.

5. A liquid ejection head according to claim 4, wherein the first electric substrate is fixed so that a part thereof is located in an elastic deformation range of the engaging portion.

6. A liquid ejection head according to claim 1, wherein the second electric contact portion is connected to a second electric substrate arranged on a liquid cartridge mounted to the case.

7. A liquid ejection head according to claim 6, wherein the spring force of the second electric contact portion is in a direction opposite to a direction of mounting of the liquid cartridge.

8. A liquid ejection head according to claim 7, further comprising a liquid supply member mounted to the case, wherein the liquid cartridge is mounted to the case via the liquid supply member.

9. A liquid ejection head according to claim 8, wherein one of the case and the liquid supply member has formed therein a groove configured to guide the connector unit along a direction in which the spring force of the first electric contact portion acts.

10. A liquid ejection head according to claim 1, wherein a spring constant K1 of the first electric contact portion and a spring constant K2 of the second electric contact portion satisfy K1>K2.

11. A liquid ejection head according to claim 1, wherein the first electric contact portion and the second electric contact portion comprise contact pins having axes shifted from each other.

12. A liquid ejection head according to claim 1, wherein the first electric contact portion and the second electric contact portion are formed so as to be integral with each other.

13. A liquid ejection head according to claim 1, wherein each of the first electric contact portion and the second electric contact portion comprises a phosphor bronze material having nickel plating applied to a surface thereof, with additional gold plating applied to tips thereof.

14. A liquid ejection head according to claim 1, wherein the fixing portion comprises a portion configured to fix a portion between the first electric contact portion and the second electric contact portion to the connector unit.

15. A liquid ejection head, comprising:

a connector unit comprising:

an electric contact member comprising a conductive member which includes an elastically deformable first electric contact portion formed on one end side thereof, and an elastically deformable second electric contact portion formed on another end side thereof; and a housing configured to fix a portion between the one end and the another end of the electric contact member; and a case in which the connector unit is movably placed.

16. A liquid ejection head according to claim 15, wherein the connector unit and the case are movably held by a snap-fit structure.

17. A liquid ejection head according to claim 15, wherein the case has a first electric substrate mounted thereon, and the first electric substrate and the first electric contact portion are electrically connected to each other.

18. A liquid ejection head according to claim 17, wherein, when a liquid cartridge including a second electric substrate is mounted, the second electric substrate and the second electric contact portion are electrically connected, the first electric contact portion and the second electric contact portion are elastically deformed, and the connector unit is displaced with respect to the case.

19. A liquid ejection head according to claim 15, wherein a spring constant K1 of the first electric contact portion and a spring constant K2 of the second electric contact portion satisfy K1>K2.

20. A liquid ejection head according to claim 15, wherein the first electric contact portion and the second electric contact portion comprise contact pins having axes shifted from each other.

* * * * *